US009765772B2

(12) United States Patent
Kwok et al.

(10) Patent No.: US 9,765,772 B2
(45) Date of Patent: Sep. 19, 2017

(54) LIQUID GEAR PUMP

(75) Inventors: Lo Ching Kwok, Hong Kong (CN); Chun Fa Wu, Shenzhen (CN)

(73) Assignee: Johnson Electric S.A., Murten (CH)

( * ) Notice: Subject to any disclaimer, the term of this patent is extended or adjusted under 35 U.S.C. 154(b) by 0 days.

(21) Appl. No.: 13/486,506

(22) Filed: Jun. 1, 2012

(65) Prior Publication Data

US 2012/0305603 A1 Dec. 6, 2012

(30) Foreign Application Priority Data

Jun. 1, 2011 (CN) ..... 2011 1 0146710

(51) Int. Cl.
*F04C 15/00* (2006.01)
*F04C 2/08* (2006.01)
*F04C 2/18* (2006.01)

(52) U.S. Cl.
CPC ..... *F04C 2/084* (2013.01); *F04C 2/18* (2013.01); *F04C 2/086* (2013.01); *F04C 2220/24* (2013.01); *F05C 2225/00* (2013.01)

(58) Field of Classification Search
CPC .... B01F 5/14; F04C 2/086; F04C 2/18; F04C 2/084; F04C 2/00; F04C 2/08; F04C 2/12; F04C 2/14; F04C 2220/24; F05C 2225/00
USPC ..... 222/368, 333, 383.2; 418/205, 206.1, 418/206.6; 417/410.4, 410.3
See application file for complete search history.

(56) References Cited

U.S. PATENT DOCUMENTS 2,759,426 A * 8/1956 Blomgren et al. ..... 418/135
2,824,524 A * 2/1958 Banker ..... 418/108
2,996,998 A * 8/1961 Gold ..... F04C 15/0026 418/131
3,128,710 A * 4/1964 Blomgren et al. ..... 417/310
3,294,028 A * 12/1966 Dahl ..... F04C 2/14 418/132
3,499,390 A * 3/1970 Prijatel ..... F04C 15/0019 418/132
3,778,200 A * 12/1973 Wellman ..... F04C 15/0026 418/132
3,833,319 A * 9/1974 Eglington ..... 418/132
5,244,367 A * 9/1993 Aslin ..... B67D 7/02 418/104
5,725,362 A * 3/1998 Zepp et al. ..... 417/366
5,788,473 A * 8/1998 Buse et al. ..... 418/206.1
6,158,983 A * 12/2000 Harpole ..... F04C 15/0049 310/67 R
7,811,072 B2 * 10/2010 Mitchell ..... 418/205
(Continued)

FOREIGN PATENT DOCUMENTS

CN 1742160 A 3/2006
CN 101137845 A 3/2008
JP 6179227 A 6/1994

*Primary Examiner* — Charles P Cheyney

(74) *Attorney, Agent, or Firm* — Muncy, Geissler, Olds & Lowe, P.C.

(57) ABSTRACT

A liquid gear pump includes a gear pump assembly and an electric motor with an motor shaft. The gear pump assembly includes a pump housing which defines a pump chamber, an inlet and an outlet which are in fluid communication with the pump chamber, and a driving gear and an idle gear which are received in the pump chamber. The driving gear is driven by the motor shaft. The idle gear is supported on an idle shaft and engaged with the driving gear. The driving gear and the idle gear are made of a material with a main component of PPS.

19 Claims, 3 Drawing Sheets

(56) References Cited

U.S. PATENT DOCUMENTS

| | | | | |
|---|---|---|---|---|
| 8,100,676 | B2 * | 1/2012 | Kjeldsen | B29C 45/14 264/250 |
| 2005/0238505 | A1 * | 10/2005 | Iwasaki | 417/410.4 |
| 2006/0024188 | A1 * | 2/2006 | Muscarella et al. | 418/206.1 |
| 2006/0165544 | A1 * | 7/2006 | Lettner | F04C 2/14 418/205 |
| 2007/0071616 | A1 * | 3/2007 | Owen et al. | 417/410.4 |
| 2008/0185399 | A1 * | 8/2008 | Yang et al. | 222/52 |
| 2008/0304981 | A1 * | 12/2008 | Chuang | 417/410.4 |
| 2009/0297384 | A1 * | 12/2009 | Seabolt | 418/191 |
| 2013/0004356 | A1 * | 1/2013 | Montipo' | 418/205 |

* cited by examiner

LIQUID GEAR PUMP

CROSS REFERENCE TO RELATED APPLICATIONS

This non-provisional patent application claims priority under 35 U.S.C. §119(a) from Patent Application No. 201110146710.1 filed in The People's Republic of China on Jun. 1, 2011.

FIELD OF THE INVENTION

This invention relates to a liquid pump and in particular, to a liquid gear pump which is especially suitable for automatic beverage dispensers.

BACKGROUND OF THE INVENTION

Gear pumps are popular for precise transfer and metering applications such as automatic beverage dispensers. A typical gear pump includes a pump housing defining a chamber, two gears received in the chamber, and a liquid inlet and a liquid outlet which are in fluid communication with the chamber. One of the two gears is a driving gear driven by a motor and the other one is an idle gear driven by the driving gear. The two gears rotate against each other so as to create the pump action. Liquid entering the pump inlet is drawn into the space between the inner surface of the chamber and teeth of the rotating gears and then is forced through the pump outlet under pressure. The flow rate of the liquid can be accurately controlled by the rotational speed of the gears, which can be regulated by varying the speed of the motor.

In some beverage dispensers the pumping of hot liquid is required. As the gears of the gear pump are immersed in the hot liquid, the gears expand creating excessive engagement between the two gears leading to excessive wear or jamming of the gears, neither of which is desired. This can be avoided by appropriate sizing of the gears to allow for the expansion, however this means that the pump does not operate efficiently with cold or warm liquids. Also, as the gear pump is in direct contact with a liquid for human consumption, the pump must satisfy the requirements of certain food safety standards.

SUMMARY OF THE INVENTION

Accordingly, in one aspect thereof, the present invention provides a liquid gear pump, comprising: a gear pump assembly; and an electric motor having a motor shaft, the gear pump assembly comprising a pump housing which defines a pump chamber, an inlet and an outlet in fluid communication with the pump chamber, and a driving gear and an idle gear disposed within the pump chamber, the driving gear being driven by the motor shaft, the idle gear being supported on an idle shaft and engaged with the driving gear; wherein the driving gear and the idle gear are made of a material with a main component of polyphenylene sulfide.

Preferably, the material contains 40 to 80 percent by weight of polyphenylene sulfide.

Preferably, the driving gear and the idle gear are made of a material with main components of polyphenylene sulfide and glass fiber.

Preferably, the material contains 40 to 80 percent by weight of polyphenylene sulfide and 20 to 60 percent by weight of glass fiber.

Preferably, the pump housing is made of a material with a main component of polyphthalamide, polyphenylene sulfide, or polyetherimide.

Preferably, the idle shaft is made of ceramic.

Preferably, the gear pump assembly further comprises an outer cover plate fixed to the pump housing at one side away from the motor, an intermediate plate fixed to the pump housing at one side near the motor, and a mounting plate mounting the gear pump assembly to the motor.

Preferably, a shaft seal is sealingly sleeved on the motor shaft to prevent the liquid from leaking out of the pump chamber along the motor shaft.

Preferably, the gear pump assembly further comprises an inner cover plate closing the pump chamber and a sealing gasket sealing the pump chamber to the inner cover plate.

According to a second aspect, the present invention provides a beverage dispenser comprising: an user interface for triggering dispensing of a beverage; a controller for controlling the dispensing of the beverage; a liquid source; a liquid supply line fluidly connected to the liquid source; and a liquid gear pump connected to the liquid supply line, for pumping the liquid from the liquid source to a dispenser point for dispensing the beverage, comprising a gear pump assembly and an electric motor having a motor shaft, the gear pump assembly comprising a pump housing which defines a pump chamber, an inlet and an outlet in fluid communication with the pump chamber, and a driving gear and an idle gear disposed within the pump chamber, the driving gear being driven by the motor shaft, the idle gear being supported on an idle shaft and engaged with the driving gear, wherein the driving gear and the idle gear are made of a material with a main component of polyphenylene sulfide.

Preferably, the material contains 40 to 80 percent by weight of polyphenylene sulfide.

Preferably, the driving gear and the idle gear are made of a material with main components of polyphenylene sulfide and glass fiber.

Preferably, the material contains 40 to 80 percent by weight of polyphenylene sulfide and 20 to 60 percent by weight of glass fiber.

Preferably, the pump housing is made of a material with a main component of polyphthalamide, polyphenylene sulfide, or polyetherimide.

Preferably, the idle shaft is made of ceramic.

Preferably, the gear pump assembly further comprises an outer cover plate fixed to the pump housing at one side away from the motor, an intermediate plate fixed to the pump housing at one side near the motor, and a mounting plate mounting the gear pump assembly to the motor.

Preferably, a shaft seal is sealingly sleeved on the motor shaft to prevent the liquid from leaking out of the pump chamber along the motor shaft.

Preferably, the gear pump assembly further comprises an inner cover plate closing the pump chamber and a sealing gasket sealing the pump chamber to the inner cover plate.

As PPS has excellent low water absorption capacity, no expansion deformation will happen to the driving gear and the idle gear even if they are immersed in the hot liquid for a long time. Therefore, the excessive engagement between the driving gear and the idle gear can be avoided. On the other hand, the introduction of the glass fiber brings the driving gear and the idle gear a better mechanical strength. Summarily, the driving gear and the idle gear are not only able to fulfill requirements for food safety standards, but have a good high temperature resistance, wearing resistance and acid resistance as well. PPS is also approved for use with food.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
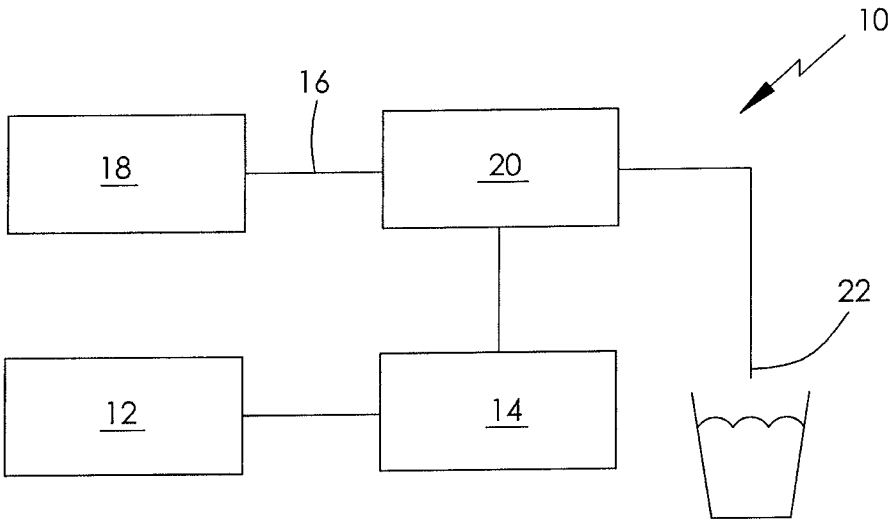
FIG. 1 is a schematic diagram of an automatic beverage dispenser incorporating a liquid gear pump in accordance with a preferred embodiment of the present invention.
Figure 2:
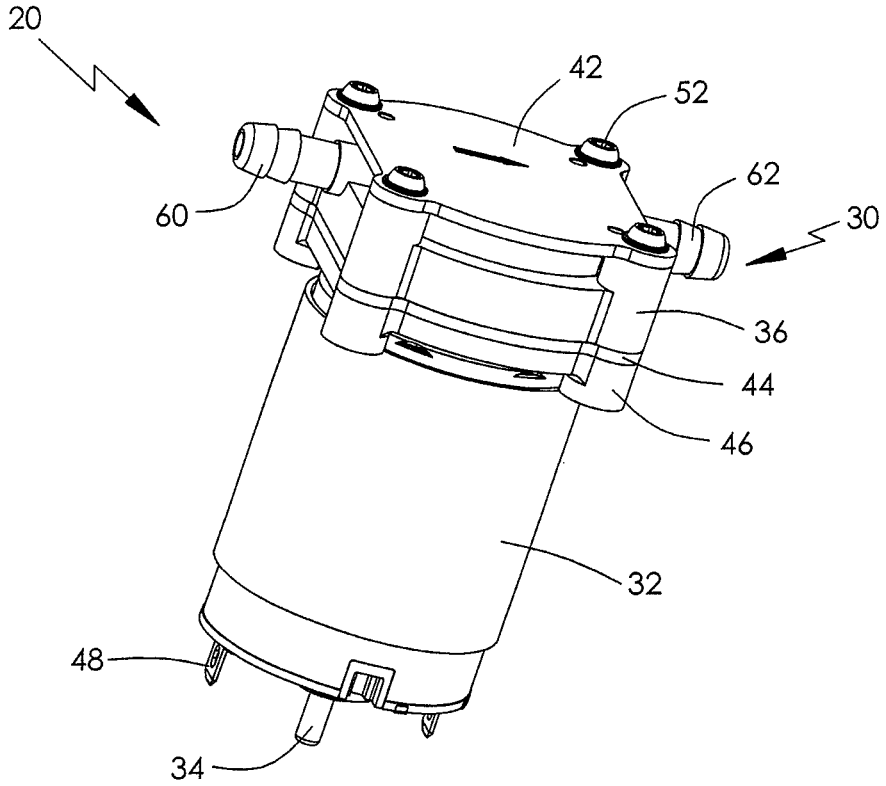
FIG. 2 is an assembled view of the liquid gear pump of FIG. 1.
Figure 3:
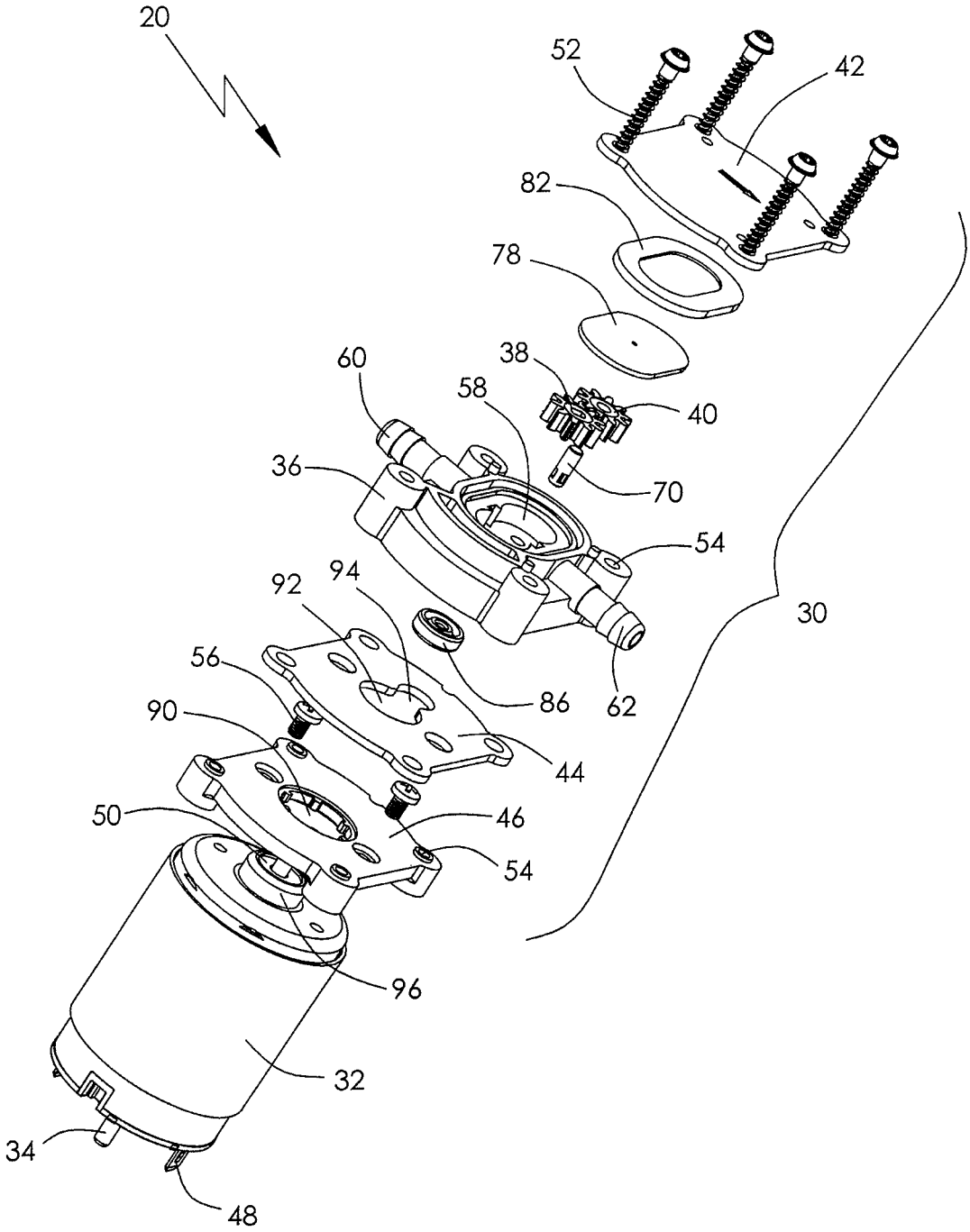
FIG. 3 is an exploded view of the liquid gear pump of FIG. 2.
Figure 4:
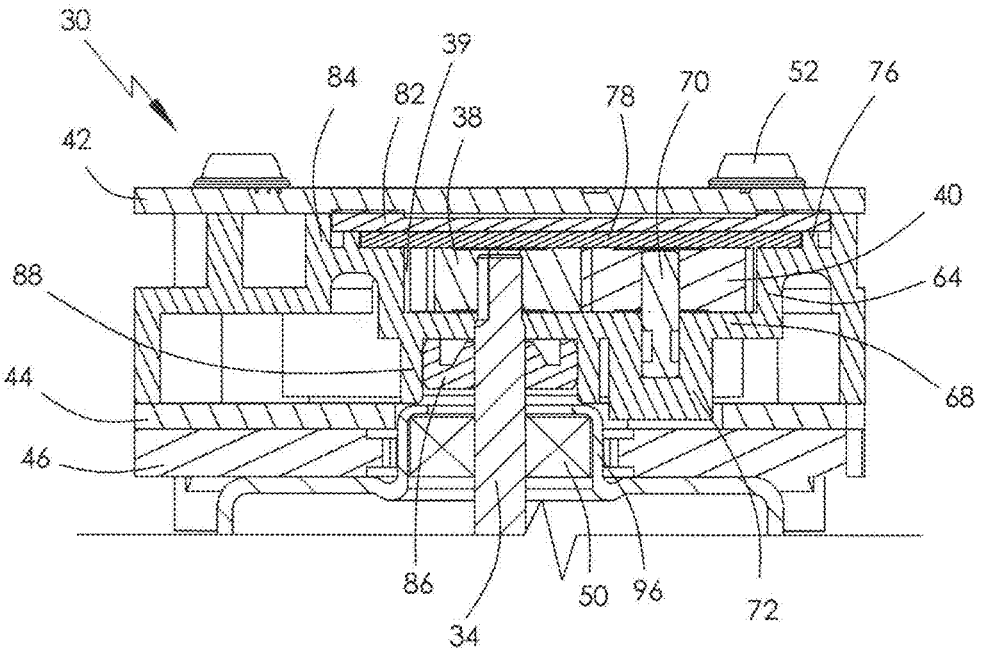
FIG. 4 is a sectional view of a gear pump assembly being a part of the liquid gear pump of FIG. 2.

FIG. 1 is a schematic diagram of an automatic beverage dispenser 10 incorporating a liquid gear pump in accordance with a preferred embodiment of the present invention. The beverage dispenser 10 comprises an user interface 12, which may be a press button, for triggering the dispensing of a beverage, a controller 14 for controlling the dispensing of the beverage, a liquid supply line 16 connecting a liquid source 18 to a liquid gear pump 20 for pumping the liquid from the liquid source 18 to a dispenser point 22 for dispensing the beverage, which may be the liquid itself or a mixture of the liquid and some other beverage material such as coffee powder.

The gear pump, or parts thereof, is shown in detail in FIGS. 2 to 5. The gear pump 20 comprises a gear pump assembly 30 driven by an electric motor 32. The motor has a motor shaft 34. The gear pump assembly 30 comprises a molded pump housing 36, a driving gear 38 coupled to the motor shaft 34 of the motor 32, an idle gear 40 rotatable mounted to an idle shaft 70 and in mesh with the driving gear 38, an outer cover plate 42 fixed to the pump housing 36 on a side remote from the motor 32, an intermediate plate 44 fixed to the pump housing 36 on the side adjacent the motor 32, and a mounting plate 46 mounting the gear pump assembly 30 to the motor 32.

The electric motor 32 has two electrical terminals 48 for electrically connecting to an external power supply. The motor shaft 34 of the motor is rotatably supported by bearings 50 at both ends of the motor 32 and passes through the mounting plate 46, the intermediate plate 44, and the pump housing 36 to drive the driving gear 38. Preferably, the motor 32 is a direct current motor. The motor shaft 34 may also extend from the motor at the end remote from the pump assembly to drive, for example, a rotation or position sensor (not shown) for monitoring operation of the pump.

The pump housing 36, the outer cover plate 42, the intermediate plate 44 and the mounting plate 46 have the same peripheral configuration in roughly rectangular shape with the longer edges parallel and the shorter edges convex and are all held together by four screws 52 engaging mounting holes 54 at the four corners thereof. The mounting plate 46 is fixed to the motor 32 via screws 56.

Figure 5:
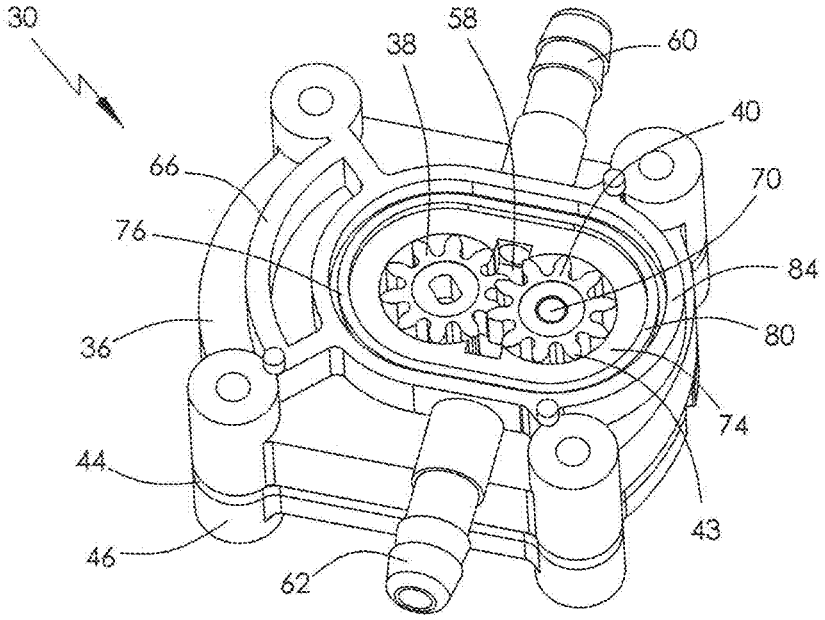
FIG. 5 is an assembled view of the gear pump assembly of FIG. 4, with inner and outer cover plates and a sealing gasket omitted to show the inner structure of the gear pump assembly.

As more clearly shown in FIG. 5, the pump housing 36 defines a pump chamber 58 that is open on one side remote from the motor 32. The pump chamber 58 is oval shaped and located nearer one of the convex sides of the pump housing 36. An inlet 60 and an outlet 62 oppositely and outwardly extend from the side wall 64 of the pump chamber 58 and are in fluid communication with the pump chamber 58. A reinforcing rib 66 is integrally molded as part of the pump housing 36 at a position near the other convex edge of the pump housing 36 to improve the mechanical strength of the pump housing.

The driving gear 38 and the idle gear 40 are received in the pump chamber 58 with a gap 39 left between radial tips 43 of teeth of the gears 38, 40 and the inner surface of the pump chamber 58. The gap 39 must be closely controlled as this directly affects the efficiency of the pump. If the gap 39 is too small there will be too much friction between the gears and the wall of the pump chamber. If the gap 39 is too big there will be poor sealing between the gears and the wall of the pump chamber allowing too much recirculation or cross flow of the liquid resulting in low pressure and low flow rate. The operating principle of a gear pump is well known. The driving gear 38 is coupled to an end of the motor shaft 34 that passes through a bottom wall 68 of the pump chamber 58, so as to rotate with the motor shaft 34. The idle gear 40 is rotatably supported by the idle shaft 70, which is supported in a boss 72 projecting away from the bottom wall 68. When the motor 32 is operating, the driving gear 38 and the idle gear 40 rotate against each other to create the pumping action so that the liquid is drawn into the pump chamber 58 from the inlet 60 and then is forced through the outlet 62 under pressure.

At the top or open side of the pump chamber 58, a first shoulder 74 is provided at an inner side of a first ring wall 76. An inner cover plate 78 closing the opening of the pump chamber 58 is seated on the first shoulder 74 and matches the inner peripheral surface of the first ring wall 76. The inner cover plate forms the upper surface of the pump chamber against which the gears 38, 40, rub. The peripheral edge of the inner cover plate 78 is axially aligned with the inner peripheral surface of the first ring wall 76. The upper surface of the first ring wall 76 forms a second shoulder 80. A sealing gasket 82 is seated on the second shoulder 80 and matches the inner peripheral surface of a second ring wall 84 surrounding the first ring wall 76. The sealing gasket 82 covers the join between the inner cover plate 78 and the second shoulder 80 so as to prevent the liquid from leaking out of the pump chamber 58 from the join. The outer cover plate 42 compresses the sealing gasket 82 against the inner cover plate 78 and the first ring wall 76. It should be noted that in FIG. 5, the outer cover plate, the sealing gasket and the inner cover plate have been omitted to show the driving gear 38 and the idle gear 40 located within the pump chamber 58 A shaft seal 86 sealingly sleeved on the motor shaft 34 is received in a recess 88 formed in the bottom wall 68 of the pump chamber 58 to seal the entry of the motor shaft into the pump chamber to prevent the liquid from leaking out between the pump chamber 58 and the motor shaft 34.

The mounting plate 46 has a circular opening 90 and the intermediate plate 44 has a keyhole shaped opening with a larger area 92 and a smaller area 94. A bearing holder 96 for supporting one of the bearings 50 is received in the circular opening 90 and the larger area 92. The boss 72 is received in the smaller area 94.

Preferably, the driving gear 38 and the idle gear 40 are made of a material with main components of polyphenylene sulfide (PPS) and glass fiber. The material may contain 40 to 80 percent by weight of PPS and 20 to 60 percent by weight of glass fiber. During operation of the gear pump, the driving gear 38 and the idle gear 40 are immersed in the liquid. As PPS has excellent low water absorption characteristics, no expansion deformation will occur in the driving gear 38 and the idle gear 40 even if they are immersed in the hot liquid for a long period of time. Therefore, the excessive engagement between the driving gear 38 and the idle gear 40 can be avoided. The introduction of the glass fiber gives the driving gear 38 and the idle gear 40 better mechanical strength. Summarily, the two gears 38, 40 are not only able to fulfill requirements for food safety standards, but have a good high temperature resistance, water ingress resistance, wear resistance and acid resistance as well.

Preferably, the pump housing 36 is made of a material with a main component of polyphthalamide (PPA). Besides its low-cost advantage, PPA has a desired low water absorption characteristics. Thus no significant expansion deformation will occur in the pump housing 36 and a stable fluid flow rate can be assured.

Preferably, the sealing gasket 82 is made of silicon rubber. The shaft seal 86 may be made of a mixture of fluoroelastomer (FKM) and polytetrafluoroethylene (PTFE).

Preferably, the inner cover plate 78, the outer cover plate 42 and the intermediate plate 44 are made of stainless steel. The mounting plate 46 may be made of plastics material. The motor shaft 34 may be made of stainless steel and the idle shaft 70 may be a ceramic material. Making the outer cover plate 42 and the intermediate plate 44 out of a rigid material such as metal, helps to maintain the flatness of the pump housing needed for the efficient operation of the gear pump. Using stainless steel extents the product life by resisting rust as well as being suitable for contact with food.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

For example, as an alternative, the pump housing 36 may be made of a material with a main component of PPS or polyetherimide (PEI).

The invention claimed is:

1. A liquid gear pump, comprising:

an electric motor having a motor shaft;

a pump housing having a pump chamber with an inner surface and an open side, an inlet and an outlet in fluid communication with the pump chamber;

a driving gear and an idle gear disposed within the pump chamber with a gap left between radial tips of teeth of both the driving and idle gears and the inner surface of the pump chamber, the driving gear being driven by the motor shaft, the idle gear being supported on an idle shaft and engaged with the driving gear;

an inner cover plate closing the open side of the pump chamber;

an inner ring wall radially spaced outward from an edge of the pump chamber to form a first shoulder between the edge and the inner ring wall to support the inner cover plate, the inner ring wall having a top surface forming a second shoulder;

an outer ring wall having a higher height than the inner ring wall and surrounding the inner ring wall and having an outer ring wall top surface;

an outer cover plate fixed to the pump housing on the outer ring wall top surface and over the inner cover plate;

an elastic sealing gasket, seated on the second shoulder and matched an inner peripheral surface of the outer ring wall, between the inner and outer cover plates and compressed by the outer cover plate against the inner cover plate, the elastic sealing gasket allowing the inner cover plate to move between the pump chamber and the outer cover plate; and wherein the driving gear and the idle gear are made of a material with a main component of polyphenylene sulfide, and wherein the material contains 40 to 80 percent by weight of polyphenylene sulfide.

2. The liquid gear pump of claim 1, wherein the driving gear and the idle gear are made of a material with main components of polyphenylene sulfide and glass fiber.

3. The liquid gear pump of claim 2, wherein the material contains 20 to 60 percent by weight of glass fiber.

4. The liquid gear pump of claim 1, wherein the idle shaft is made of ceramic.

5. The liquid gear pump of claim 1, further comprising:

an intermediate plate fixed to the pump housing at one side near the motor; and a mounting plate between the pump housing and the motor and mounting the pump housing to the motor.

6. The liquid gear pump of claim 1, wherein a shaft seal is sealingly sleeved on the motor shaft to prevent the liquid from leaking out of the pump chamber along the motor shaft.

7. A beverage dispenser comprising:

a beverage supply line; and a gear pump connected to the beverage supply line, comprising:

an electric motor having a motor shaft;

a bearing disposed on the motor shaft;

a solid bearing holder sleeved around the bearing;

a pump housing having a pump chamber with an inner surface and an open side, an inlet and an outlet in fluid communication with the pump chamber;

a driving gear disposed within the pump chamber and driven by the motor shaft;

an idle gear disposed within the pump chamber, being supported on an idle shaft and engaged with the driving gear, a gap being left between radial tips of teeth of both the driving and idle gears and the inner surface of the pump chamber;

a boss projecting away from the pump housing and supporting the idle shaft;

a plate assembled between the pump housing and the motor and having an opening with a first area receiving the bearing holder and a second area receiving the boss, the first area of the opening communicated with the second area of the opening;

an inner cover plate closing the open side of the pump chamber;

an inner ring wall radially spaced outward from an edge of the pump chamber to form a first shoulder between the edge and the inner ring wall to support the inner cover plate, the inner ring wall having a top surface forming a second shoulder;

an outer ring wall having a higher height than the inner ring wall to surround the inner ring wall and having an outer ring wall top surface;

an outer cover plate fixed to the pump housing on the outer ring wall top surface and over the inner cover plate;

an elastic sealing gasket, seated on the second shoulder, between the inner and outer cover plates and compressed by the outer cover plate against the inner cover plate, the elastic sealing gasket allowing the inner cover plate to move between the pump chamber and the outer cover plate; and wherein the driving gear and the idle gear are made of a material with a main component of polyphenylene sulfide and the material contains 40 to 80 percent by weight of polyphenylene sulfide.

8. The beverage dispenser of claim 7, wherein the driving gear and the idle gear are made of a material with main components of polyphenylene sulfide and glass fiber.

9. The beverage dispenser of claim 8, wherein the material contains 20 to 60 percent by weight of glass fiber.

10. The beverage dispenser of claim 7, wherein the idle shaft is made of ceramic.

11. The beverage dispenser of claim 7, wherein the gear pump further comprises an outer cover plate fixed to the pump housing at one side away from the motor, and a mounting plate arranged between said plate and the motor and mounting the pump housing to the motor.

12. The beverage dispenser of claim 7, wherein a shaft seal is sealingly sleeved on the motor shaft to prevent the liquid from leaking out of the pump chamber along the motor shaft.

13. An automatic beverage dispenser incorporating the liquid gear pump of claim 1.

14. The liquid gear pump of claim 1, wherein:

the inner ring wall is positioned at the open side of the pump chamber with the first shoulder provided at an inner side of the ring wall;

the inner cover plate matches an inner peripheral surface of the inner ring wall, and is axially aligned with an upper surface of the inner ring wall; and the sealing gasket covers the join between the inner cover plate and the upper surface of the inner ring wall.

15. The liquid gear pump of claim 14, wherein an outer surface of the sealing gasket contacts an inner peripheral surface of the outer ring wall surrounding the inner ring wall.

16. The liquid gear pump of claim 5, wherein:

the liquid gear pump further comprises:

a bearing disposed on the motor shaft;

a bearing holder sleeved around the bearing; and a boss projecting away from the pump housing and supporting the idle shaft; and the intermediate plate is arranged between the pump housing and the motor and has an opening with a first area receiving the bearing holder and a second area receiving the boss.

17. The beverage dispenser of claim 7, wherein:

the inner ring wall is positioned at the open side of the pump chamber with the first shoulder provided at an inner side of the ring wall;

the inner cover plate matches an inner peripheral surface of the inner ring wall, and is axially aligned with an upper surface of the inner ring wall; and the sealing gasket covers the join between the inner cover plate and the upper surface of the inner ring wall.

18. The liquid gear pump of claim 1, wherein the inlet and outlet directly and outwardly extend from two opposite side walls of the pump chamber.

19. The liquid gear pump of claim 16, wherein the boss has a bottom wall to support the idle shaft.

* * * * *